US008135433B2

(12) United States Patent
Pedersen

(10) Patent No.: US 8,135,433 B2
(45) Date of Patent: Mar. 13, 2012

(54) REDUCTION IN INTERFERENCE BETWEEN COMPONENTS

(75) Inventor: Per Pedersen, Slagelse (DK)

(73) Assignee: Nokia Corporation, Espoo (FI)

( * ) Notice: Subject to any disclaimer, the term of this patent is extended or adjusted under 35 U.S.C. 154(b) by 628 days.

(21) Appl. No.: 12/315,502

(22) Filed: Dec. 2, 2008

(65) Prior Publication Data

US 2010/0137019 A1 Jun. 3, 2010

(51) Int. Cl.
*H01Q 1/52* (2006.01)
*H01Q 1/24* (2006.01)

(52) U.S. Cl. ..... 455/550.1; 336/223; 455/90.3; 455/570; 381/98

(58) Field of Classification Search ..... 455/550.1, 455/90.3, 570; 336/223; 391/98
See application file for complete search history.

(56) References Cited

U.S. PATENT DOCUMENTS

2005/0206490 A1 * 9/2005 Castaneda et al. ..... 336/223

FOREIGN PATENT DOCUMENTS

| | | |
|---|---|---|
| EP | 1703585 | 9/2006 |
| JP | 2006108942 | 4/2006 |
| JP | 2007325042 | 12/2007 |
| WO | WO 2006117439 | 11/2006 |
| WO | WO 2007/135230 | 11/2007 |

* cited by examiner

*Primary Examiner* — Joseph Chang
(74) *Attorney, Agent, or Firm* — Alfred A. Fressola; Ware, Fressola, Van Der Sluys & Aldolphson LLP

(57) ABSTRACT

An apparatus is disclosed comprising a transducer, which transducer comprises at least one electrical connection point configured to enable an external electrical connection of the transducer. The transducer further comprises at least one decoupling coil configured to electrically decouple the transducer from the at least one electrical connection point at a frequency above an operating frequency of the transducer. Moreover, a method for assembling the described apparatus is disclosed.

20 Claims, 4 Drawing Sheets

REDUCTION IN INTERFERENCE BETWEEN COMPONENTS

TECHNICAL FIELD

The invention relates to interferences between different components of a device, for example to a constellation in which a transducer of a device acts as a load on an antenna of the device.

BACKGROUND OF THE INVENTION

The development of mobile devices, in particular mobile phones, is characterized by different trends often having complex, interrelated implications.

One of these trends is the increasing need for multimedia capability, which includes high quality audio playback, be it for entertainment or for telecom audio. There is also the market's desire for integrated hands free speaker capability. These two needs can be met with high-quality integrated hands free speakers, which can for example be used for integrated hands free functionality, for playback of recorded audio, for frequency modulated (FM) radio playback, for high-quality playback of ringtones that are, for example compressed audio or digital audio files or for any other situation in which audio is generated by the mobile device.

Another trend is that in modern mobile phones the market demands antennas that are not visible to the user. The presence of an external antenna protruding from the housing of the mobile phone makes putting the mobile phone in a pocket less practical and is also unsatisfactory under aesthetic and design considerations.

Thus the antenna is regularly placed within the housing of the mobile phone. Both the antenna and the integrated hands free speaker, however, require a certain volume (three-dimensional space) within the mobile phone for physical reasons in order to be effective, volume which is becoming ever scarcer in increasingly miniaturized electronics. In fact, this often leads to placing the antenna and the integrated hands free speaker within the same cavity in the mobile phone. In addition, to achieve stereo effect, a mobile phone may comprise at least two integrated hands free speakers, thus further adding to the need for space in the device and concentration of such components within the same area. Just like for a phone antenna, a similar situation may also exist for a wireless local area network (WLAN) or Bluetooth® antenna. Thus the one or more antennas and the one or more transducers compete for the limited available volume that is shared by these different components. As a result, generally a compromise in the volume allocation between these competing requirements is made.

In a situation with such sharing of volume, the load caused by an integrated hands free speaker on the antenna is increased due to its proximity to the antenna and because a miniaturized, internal antenna has less favorable sensitivity characteristics than an antenna which is larger or external. This load on the antenna is detrimental to its operation. The severity of defect on the antenna depends on the mechanical design of the transducer as well as its location within the electronic equipment such as a mobile phone.

SUMMARY OF SOME EXEMPLARY EMBODIMENTS OF THE INVENTION

A first apparatus is described which comprises a transducer. The transducer comprises at least one electrical connection point configured to enable an external electrical connection of the transducer. The transducer further comprises at least one decoupling coil, which at least one decoupling coil is configured to electrically decouple the transducer from the at least one electrical connection point at a frequency above an operating frequency of the transducer.

Also, a method is described which comprises assembling an apparatus, which apparatus comprises a transducer. The transducer comprises at least one electrical connection point for enabling an external connection of the transducer. The method also comprises arranging at least one decoupling coil within the transducer to electrically decouple the transducer from the at least one electrical connection point at a frequency above an operating frequency of the transducer.

Further, a second apparatus is described which comprises a transducer comprising structure(s) (means) for establishing at least one electrical connection enabling an external connection of the transducer, to which means for establishing at least one electrical connection the transducer is electrically connected. The transducer further comprises structure(s) (means) for electrically decoupling the transducer from the at least one electrical connection point at a frequency above an operating frequency of the transducer. It is to be understood that further or correspondingly adapted structure(s) (means) may be comprised for realizing any of the functions that may optionally be implemented in any described embodiment of the first apparatus.

Moreover, a third apparatus is described comprising structure(s) (means) for assembling a transducer comprising at least one electrical connection point enabling an external connection of the transducer. The apparatus further comprises structure(s) (means) for arranging at least one decoupling coil to electrically decouple the transducer from the at least one electrical connection point at a frequency above an operating frequency of the transducer. It is to be understood that further or correspondingly adapted structure(s) (means) may be comprised for realizing any of the method steps that may optionally be implemented in any described embodiment of the first method.

Structures around an antenna, especially large structures comprising metal, for example a speaker comprising a voice coil, may diminish the sensitivity of antennas that are operating in the vicinity of these structures by loading the antenna. This holds in particular for the voice coil of a speaker of a device arranged near the antenna of that device. The load effect of these structures can be reduced by decoupling them from other, more extensive elements of circuitry, like for example those arranged on a printed wire board. A load-creating component of a transducer could be decoupled from the further circuitry by connecting a decoupling coil within the transducer between the load creating component and an electrical connection point.

Embodiments of the described methods and apparatuses offer advantages from a variety of perspectives. These advantages are to the benefit of the operation of the antenna, the operation of the transducer, but also for the layout of the printed wire board as well as the energy consumption of the system. The advantages even extend to the assembly and manufacturing process as well as to component sourcing and lean production.

Certain embodiments of the described first apparatus, the described second apparatus, the described third apparatus and the described method may allow improving the performance of an antenna comprised in a device comprising the first apparatus or the second apparatus. Suitably arranged inductive coils may decouple a transducer, consequently reducing the load of the transducer on the antenna. The decoupling coils form a high impedance at the antenna signal frequencies and thus prevent undesired currents generated by energy branched off from the antenna. Thus the antenna may transmit and receive signals more efficiently.

Embodiments of the described first apparatus, the described second apparatus, the described third apparatus and the described method may prevent long signal lines from the transducer to the decoupling coils to contribute to the transducer's load on the antenna in an unpredictable way. This is because a significant length of signal line between the decoupling coils and the transducer would also be "seen" by the antenna and would thus exacerbate the loading of the antenna by the transducer. When the decoupling takes place before this long signal line, i.e. within the transducer, the need for an additional increase in the size of the decoupling coils is avoided and using a smaller inductance for the decoupling coils is made possible. This is because decoupling the signal lines from the transducer reduces the total load and also because the unpredictable way in which the signal lines contribute to the load is eliminated. Thus the decoupling coils may be tuned more closely to the actual load of the transducer on the antenna. The reduced inductance of the decoupling coils thus needed makes it possible to reduce the resistance of the decoupling coils. Therefore, the size of decoupling coils can be smaller when they are integrated between the components of the transducer than if they were positioned externally. With a lower resistance of the decoupling coils, the efficiency of the amplifiers driving the transducer is increased which means the efficiency of the transducer output is increased for various kinds of transducers that could be employed, like integrated handsfree loudspeaker, earpiece, etc.

There are also embodiments of the described first apparatus, the described second apparatus, the described third apparatus and the described method which enable an even closer matching of the decoupling coils to the load of the transducer on the antenna, namely when a handset or some other entity comprises a transducer and an antenna. In this case the loading effect of the transducer on the antenna can be determined very precisely and the decoupling coils dimensioned accordingly. In addition, the matching of the decoupling coils to the antenna becomes largely independent on the assembly of the transducer into an electronic device.

Embodiments of the described first apparatus, the described second apparatus, the described third apparatus and the described method may also allow saving space on a printed wire board and making routing on the printed wire board easier. By using smaller decoupling coils within the transducer rather than bigger decoupling coils on a printed wire board potentially further away from the transducer, the total volume needed for the decoupling coils is reduced. This effect by itself mitigates the often tight layout and routing constraints on the printed wire board. Also, the total number of components is reduced, which is also advantageous to the routing of electrical connections within a device.

Moreover, embodiments of the described first apparatus, the described second apparatus, the described third apparatus and the described method may enable a more flexible assembly of the transducer in an electronic device without the need for enlarged decoupling coils. Some transducers may be assembled into a device like a mobile phone using one of multiple orientations and consequently using a different set of contact points for each orientation. This results in one of two different lengths of signal line to the transducer on the printed wire board needing to be accounted for. When the decoupling coils are comprised in the transducer, the difference in length of the signal lines does not have to be considered in the dimensioning of the decoupling coils. Moreover, the complexity of the architecture and the total number of components used in assembly is reduced, thus also reducing assembly steps and potential sources of errors. Furthermore, the transducer itself may be more antenna neutral, thus providing more options for combination of components and thus greater flexibility in sourcing and reconfiguration.

In addition, embodiments of the described first apparatus, the described second apparatus, the described third apparatus and the described method may improve the logistics of manufacturing in the same way as improving the assembly itself due to a reduced number of individual components.

Moreover, embodiments of the described first apparatus, the described second apparatus, the described third apparatus and the described method may enable making a compromise between an antenna and the transducer unnecessary, because both components benefit equally from the decoupling coils being comprised in the transducer.

According to an exemplary embodiment of the described first apparatus, the described third apparatus and the described method, the transducer is an arrangement of one or more components that converts electrical energy to another type of energy or converts another type of energy to electrical energy. The transducer may be for instance a dynamic transducer based on a moving coil technology. The transducer may also be a transducer based on transducer technology such as piezoelectric, ceramic, electrostatic, multifunction device, vibra, earpiece buzzer and even microphone. The microphone may be a digital microphone or an analogue microphone. The analogue or digital microphone may be a microphone of an array of multiple microphones comprised in the apparatus. The microphone may also be a microphone of an array of two microphones for stereo functionality.

The at least one electrical connection point may be a contact configured to electrically connect the transducer to one or more external components. The at least one electrical connection point may be a conducting surface. The at least one electrical connection point may be a leaf contact or a spring contact. The at least one electrical connection point may also be an electrical connector. The at least one electrical connection point may be configured to be contacted by a connector. The at least one electrical connection point may be configured to enable an electrical connection between the transducer and another component of a device comprising the apparatus. The one or more external components may comprise a printed wire board.

The at least one electrical connection point could comprise for example two electrical connection points of the transducer. The transducer may comprise two decoupling coils. The decoupling coils may be arranged symmetrically within the transducer. A first decoupling coil may be very close to a first electrical connection point of the transducer and a second decoupling coil may be very close to a second electrical connection point of the transducer.

Alternatively, the at least one electrical connection point could be for example a single electrical connection point of the transducer. A casing of the transducer may be used for ground and an electrical connection point of the transducer may be used as a single terminal of the transducer, for example in the case of an analogue transducer, like an analogue microphone or an earpiece, or in the case of a digital microphone. For the case that the electroacoustic transducer is a digital microphone or an active microphone, a casing of the transducer unit may comprise a metal shield designed as a Faraday cage that protects against radio frequency radiation. The casing of the transducer may be decoupled with a decoupling coil as well. For the situation that a casing of the transducer is used for ground and an electrical connection point of the transducer is used as a single terminal of the transducer, a first decoupling coil may be arranged between components of the transducer and the electrical connection point and a second decoupling coil may be arranged between components of the transducer and the casing of the transducer. In an alternative embodiment, there may be only a decoupling coil arranged between components of the transducer and the electrical connection point of the transducer. A decoupling of the casing may be done with a decoupling coil outside the transducer.

A transducer may be comprised in an integrally formed transducer unit. A transducer may also be an integrally formed transducer unit.

The components of the transducer may be contained, for example, in a single housing. The housing containing the transducer may comprise openings in the surface of the housing. A volume for audio generation of the transducer may be outside the housing containing the transducer.

A volume for audio generation of the transducer may be comprised inside the housing containing the transducer. A volume for audio generation of the transducer may moreover be outside the transducer. Alternatively, a volume for audio generation of the transducer may be comprised inside the transducer. Having a volume for audio generation of the transducer be comprised inside the transducer may be relevant to small tweeters with Bluetooth® or such large transducer sizes when designed for WLAN or laptop applications. The transducer may be an integrated transducer. The transducer may moreover be a miniaturized transducer. The transducer may be an encased transducer.

In an exemplary embodiment of the described first apparatus and the described method the at least one decoupling coil may be a series of loops of a conductor. The at least one decoupling coil may be any electrical component forming an inductance. Electrically decoupling the transducer from the at least one electrical connection point may comprise creating a high impedance between the transducer and the at least one electrical connection point. An operating frequency of the transducer may be a frequency of an electrical signal which may be supplied to the transducer for proper operation of the transducer. A frequency range may define the operating frequencies of the transducer. For example, a transducer may have operating frequencies corresponding to the frequency band of audible sound if the transducer is an electro-acoustic transducer. Electrically decoupling the transducer from the at least one electrical connection point at a frequency above an operating frequency of the transducer may comprise creating a high impedance between the transducer and the at least one electrical connection point within a selected frequency range, for example within the exemplary range of about 100 kHz to 300 GHz. The selected frequency range may have an arbitrary positive distance from an operating frequency of the transducer. The at least one decoupling coil may be configured to electronically decouple the transducer from the at least one electrical connection point by having an inductance which results in a high impedance at a frequency within the range of about 100 kHz to 300 GHz. The transducer may comprise two decoupling coils. The first decoupling coil may be arranged between components of the transducer and a first of the at least one electrical connection point of the transducer. The second decoupling coil may be arranged between components of the transducer and a second of the at least one electrical connection point.

According to an exemplary embodiment of the described first apparatus and the described method, the at least one decoupling coil is a self-inductive coil. Having the at least one decoupling coil be a self-inductive coil would have the effect that the inductance of the decoupling coil is created by the mechanical structure of a conducting wire and is thus easy to manufacture and in addition durable.

In an exemplary embodiment of the described first apparatus, the described second apparatus and the described method, the apparatus comprises in addition an antenna. The antenna may be housed in the same modular component as the transducer. The antenna may be configured to be operationally connected to from outside the apparatus. Having the apparatus comprise an antenna could have the effect that the transducer, which may require volume for its functionality, as well as the antenna, which may also require volume for its functionality, may be handled in an easy manner as a single entity. Moreover the total volume consumption of an apparatus comprising the transducer and the antenna could be less than the combined volume consumption of another apparatus comprising the transducer and yet another separate apparatus comprising the antenna.

The antenna can be any possible antenna that might be influenced by a transducer.

According to an exemplary embodiment of the described first apparatus, the described second apparatus, the described third apparatus and the described method, the antenna may be an antenna for communicating in a cellular network. The cellular network may be a global system for mobile communications (GSM) cellular network, a wideband code division multiple access (WCDMA) cellular network, a code division multiple access (CDMA) cellular network, or a universal mobile telecommunications system (UMTS) cellular network. The cellular network may also be any other kind of cellular network. The antenna may be used for reception and/or transmission of signals. If the antenna is an antenna for a cellular network, an embodiment of the described first apparatus could have the effect of reducing total volume consumption of a component of a device using a cellular network, which would thus be a mobile device.

According to an exemplary embodiment of the described first apparatus, the described second apparatus, the described third apparatus and the described method, the antenna is an antenna for communicating with a wireless network. Such a wireless network may be a WLAN, a Bluetooth® network, a Wi-Fi network, a satellite telephone network, a digital enhanced cordless telecommunications (DECT) network or any other wireless network.

In an exemplary embodiment of the described first apparatus, the described third apparatus and the described method, the transducer is an electromechanical transducer. The electromechanical transducer may be a vibrating alert motor of a device, for example the vibrating alert motor of a mobile phone.

In an exemplary embodiment of the described first apparatus, the described third apparatus and the described method, the transducer is an electroacoustic transducer. The electroacoustic transducer may be an entity which converts electrical signals to acoustic signals. The electroacoustic transducer may be a loudspeaker, for example the loudspeaker for integrated hands free functionality of a device. The electroacoustic transducer may also be the electroacoustic transducer of a buzzer of a device or of an earpiece of a device. The electroacoustic transducer may have operating frequencies corresponding to the frequencies of audible sound. The electroacoustic transducer may also have operating frequencies in a frequency band which is a subset of the frequency band of audible sound. The electroacoustic transducer may be integrated in a housing which comprises an opening configured to enable the generation of acoustic signals by the electroacoustic transducer.

According to an exemplary embodiment of the described first apparatus, the described third apparatus and the described method, the electroacoustic transducer may comprise a voice coil. The voice coil may be a coil of wire attached to the cone or diaphragm of a loudspeaker. Alternatively or in addition, the electroacoustic transducer may comprise a piezo speaker. The electroacoustic transducer may comprise an analogue microphone. The electroacoustic transducer may comprise a digital microphone comprising pins. The pins of the digital microphone may be configured to be soldered on a printed wire board using surface mounted device technology. The pins may be metal pins and decoupling coils may be provided within the digital microphone in baseband to shield/ground.

In an exemplary embodiment of the described first apparatus, the described third apparatus and the described method, the electroacoustic transducer may comprise a magnet. The magnet may be the magnet of a loudspeaker.

If the transducer has a housing, the housing of the transducer may be a plastic housing. The housing of the transducer may also be a metal housing, for example if the transducer is an earpiece, or a metal cover. In this case the metal housing may also be decoupled. The transducer may also comprise other metal components which may influence antenna performance. The transducer may for example comprise a metal chassis, a metal cover, or metal terminals. The metal terminals may comprise a metal leaf or metal springs that may influence antenna performance as well. The other metal components comprised in the transducer may also be decoupled to decrease the load on an antenna.

The at least one decoupling coil may be electrically connected and positioned anywhere between a component of the transducer and the at least one electrical connection point of the electroacoustic transducer.

According to an exemplary embodiment of the described first apparatus, the described third apparatus and the described method, the at least one decoupling coil is positioned adjacent to at least one of the at least one electrical connection point and a voice coil of an electroacoustic transducer.

In a first way of positioning the at least one decoupling coil, the at least one decoupling coil may be positioned adjacent to the at least one electrical connection point. The at least one decoupling coil may be positioned immediately adjacent to the at least one electrical connection point. This could have the effect of enabling easily adding the decoupling coils without significantly changing design specifications of their existing modules and it can be expected to result in good performance. If there are at least two decoupling coils and at least two electrical connection points, two decoupling coils may be positioned adjacent to the at least one electrical connection point with each decoupling coil electrically connected to one respective electrical connection point. The at least two decoupling coils may but do not have to be positioned symmetrically with respect to the two electrical connection points.

In an alternative way of positioning the at least one decoupling coil, the at least one decoupling coil may be positioned immediately adjacent to the voice coil. If there are at least two decoupling coils, two decoupling coils may be positioned adjacent to the voice coil with each decoupling coil electrically connected to one respective end of the voice coil. The at least two decoupling coils may but do not have to be positioned symmetrically with respect to the voice coil. Having the at least one decoupling coil be positioned adjacent to the voice coil could have the effect of reducing the space between the voice coil and the at least one decoupling coil which space may comprise an entity forming a parasitical load to an antenna in an unpredictable way.

In an exemplary embodiment of the described first apparatus, the described third apparatus and the described method, the inductance of the at least one decoupling coil is matched to the load of the transducer on the antenna. The inductance of the at least one decoupling coil may be configured to decouple the transducer from the at least one electrical connection point with regard to the radio signals emitted by the antenna. The characteristics of the radio signals emitted or received by the antenna and the sensitivity of the antenna may be known because the operating parameters of the antenna as well as the geometrical position of the antenna relative to the transducer are known. Thus the inductance may be chosen such that it results in a high impedance at the frequency range used by the antenna. Having the inductance of the at least one decoupling coil be matched to the load of the transducer on the antenna could have the effect that the inductance may be chosen sufficiently high to decouple the transducer from the at least one electrical connection point in the frequency range used by the antenna but may simultaneously be chosen sufficiently low so as to limit negative effects on the efficiency of the amplifiers driving the transducer. Thus the inductance may be determined so as to provide sufficiently high impedance for the purpose of reducing the load on the antenna. Having the inductance of the at least one decoupling coil be matched to the load of the transducer of the antenna could have the effect of enabling the reduction of the load on the antenna by the transducer. At the same time, the need for additional amplification for driving the transducer can be avoided. If the transducer is a loudspeaker, then a match of the inductance of the at least one decoupling coil may prevent compromising the achievable loudness of the loudspeaker and the sensitivity and nonlinearity of the loudspeaker may be improved compared to the case of an unmatched decoupling coil.

According to an exemplary embodiment of the described first and second apparatus, the apparatus is configured to fit into a cavity within a device, which device may be a mobile device. According to an exemplary embodiment of the described method, the apparatus is fit into a cavity within a device, which device may be a mobile device. The apparatus may be configured to be enclosed within a device. Having the apparatus be configured to fit into a cavity within a mobile device could have the effect of allowing the use of the apparatus as module for a device without changing the visible shape of the device. The apparatus may be configured to fit into a cavity within a device, which cavity may also be configured to house an antenna. The antenna which the cavity may be configured to house may be a phone antenna, a WLAN antenna, a Bluetooth® antenna, or any other kind of antenna.

In an exemplary embodiment of the described first apparatus, the described third apparatus and the described method, the at least one connection point is configured to enable an external electrical connection of the transducer to a printed wire board external to the transducer. The transducer may be configured to be electrically connected to a printed wire board via the at least one electrical connection point. The transducer may also be configured to be connected to a printed wire board at the at least one electrical connection point via a connector. The transducer may be operationally connected to the printed wire board with connectors that are mechanically rigid. The transducer may also be operationally connected to the printed wire board via a flex operationally connected to the at least one electrical connection point. This may have the technical effect of allowing the first apparatus to be used as a transducer unit for an electronic device, which electronic device comprises the printed wire board, while providing an integrated decoupling of the transducer from the printed wire board at radio frequencies. Thus it could be that no additional components for decoupling are required, thereby reducing the total number of components. Moreover, the mechanical construction of the printed wire board as well as the electrical routing on the printed wire board as a whole could be made easier because these additional components may be omitted.

In an exemplary embodiment of the described first apparatus, the described second apparatus and the described method, the at least one electrical connection point is positioned symmetrically on the apparatus and the apparatus is electrically symmetric independent of the orientation of the apparatus. In particular, the apparatus may be electrically symmetric independent of the orientation of the apparatus when fit into the cavity within the mobile device. The at least one electrical connection point may be positioned in a corner of the apparatus. Thus the apparatus may be rotationally symmetric such that it may be inserted into the cavity at any of the symmetric rotation positions and be functional from a mechanical as well as from an electrical point of view. This could have the effect of making the assembly of the mobile device easier because the functionality of the apparatus would be independent of the actual one of the symmetric orientations of the apparatus. Thus a special procedure for ensuring a particular orientation during assembly could be unnecessary.

According to an exemplary embodiment of the described first apparatus, the described second apparatus and the described method, the transducer may be a circular transducer. The circular transducer may comprise a mechanical protrusion configured to ensure fitting the circular transducer in a unique orientation. Alternatively or in addition, the circular transducer may comprise two electrical connection points which are symmetrical with regard to rotation. For example, the circular transducer may comprise two electrical connection points which are concentric rings. The at least one electrical connection point of the circular transducer may be a leaf contact, a spring contact, a flexy connection, or any other kind of connection. The at least one electrical connection point of the circular transducer may also be configured to connect to external components by a wired connection, which wired connection is soldered on a printed wire board.

According to an exemplary embodiment of the described first apparatus, the described second apparatus and the described method, the apparatus comprises a display. In this case, the apparatus could be a fully functional device, like a mobile phone. Alternatively, the described apparatus may be a module for a device. The described apparatus may be, for example, a module for a device comprising a display. The display could be e.g. a flat panel transducer configured to combine audio and visual.

In an exemplary embodiment of the described first and third apparatus and the described method, the transducer is an integrated hands free speaker. An integrated hands free speaker may be used as a loudspeaker of a mobile device when the mobile device is operational in the integrated hands free mode, in which mode the user of the mobile device does not hold the mobile device in his hands but has it placed at a moderate distance, for example on a table in front of him. Thus the integrated hands free speaker may need to achieve a higher volume than a speaker for the hand portable mode, because it may not be as close to the ear of the user as when the user is holding the mobile device in his hand right at his ear. The integrated hands free speaker may also be used for playback of a digital audio ringtone or a compressed audio ringtone, like for example a ringtone encoded according to the moving pictures experts group 1 audio layer 3 (MP3) standard, in addition or as an alternative to using a buzzer for the ringtone. The apparatus may be a module for a mobile device that provides audio playback functionality such as an integrated hands free speaker or earpiece.

According to an exemplary embodiment of the described first apparatus and the described method, the apparatus is equal to the transducer, but it could also be for instance an electronic device or a module for an electronic device.

In an exemplary embodiment of the described first apparatus, a transducer unit is described comprising the described first apparatus. A transducer unit may be a module comprising a loudspeaker and an antenna. The loudspeaker may be the loudspeaker for the integrated hands free functionality of a mobile device. The antenna may be the antenna for the cellular network of a mobile device.

It is to be understood that any feature presented for a particular exemplary embodiment may also be used in combination with any other described exemplary embodiment of any category.

Further, it is to be understood that the presentation of the invention in this section is merely exemplary and non-limiting.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

DETAILED DESCRIPTION OF THE FIGURES

In the following detailed description of FIGS. 1 to 4, exemplary embodiments of the present invention will be described in the context of a transducer that is a loudspeaker for integrated hands free functionality. It is readily understood that the present invention is equally well applicable to various other kinds of transducers. Moreover, in the following detailed description of FIGS. 1 to 4, exemplary embodiments of the present invention will be described in the context of a transducer that is a rectangular shaped transducer. It is understood that the present invention is also equally well applicable to differently shaped transducers, such as circular transducers, elliptic shaped transducers, or transducers of any other shape.

Figure 1:
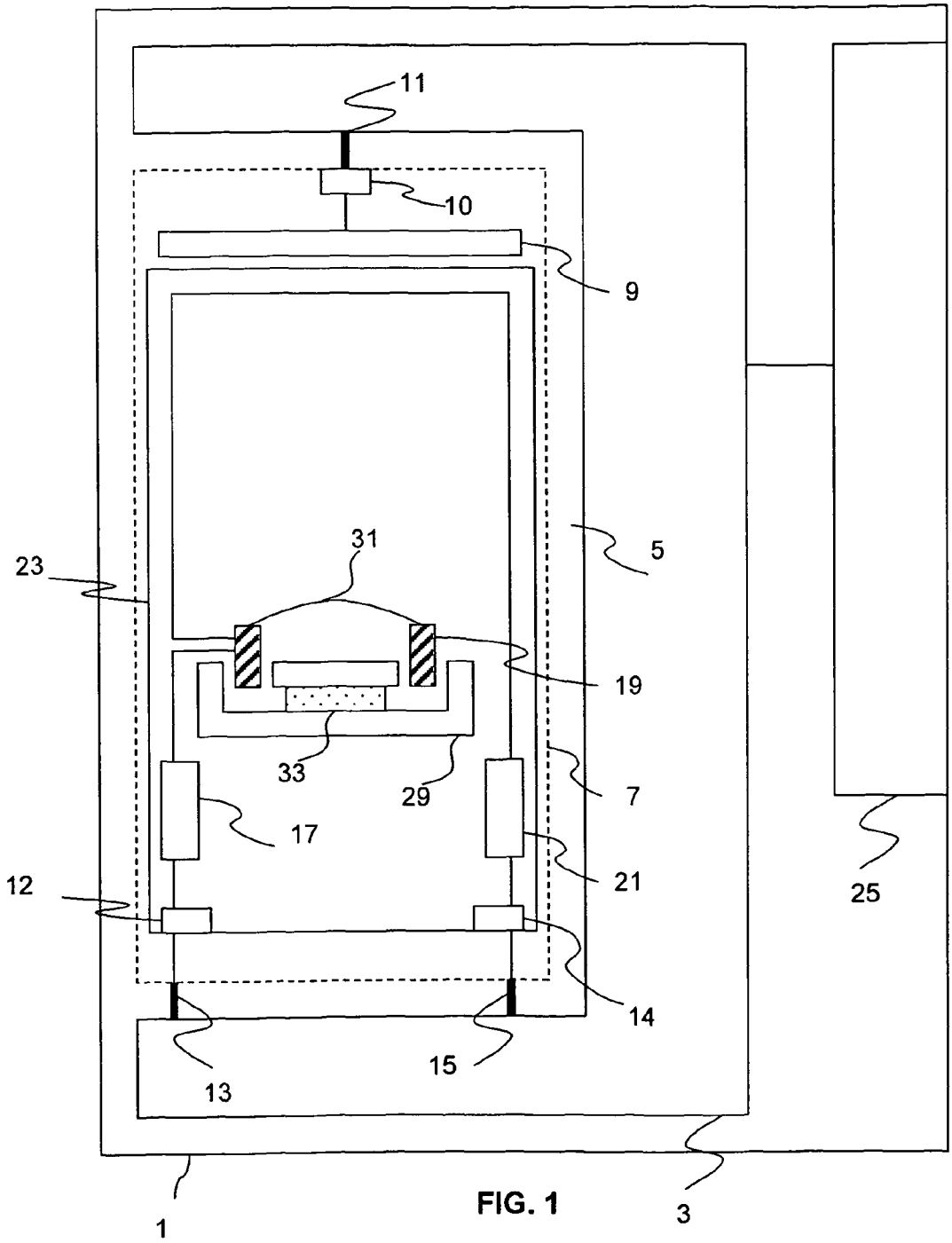
FIG. 1 is a schematic diagram illustrating a portable device comprising a first or second apparatus according to a first exemplary embodiment of the invention.

FIG. 1 illustrates a portable device, in this case a mobile phone 1, comprising in this case by way of example, an assembly 7 with an antenna 9 and a transducer, in this case a hands free loudspeaker 23. The assembly 7 may be a loose arrangement of the hands free loudspeaker 23 and the antenna 9 in a section of the mobile phone 1 with some free volume. The assembly 7 may also be a rigidly connected arrangement of the hands free loudspeaker 23 and the antenna 9. Alternatively, the assembly 7 may also be a miniaturized transducer unit and/or an integrated transducer unit. The portable device 1, the hands free loudspeaker 23 or the assembly 7 can be seen as an exemplary first or second apparatus according to the invention. The mobile phone 1 may be a mobile phone for a GSM cellular network, for a UMTS cellular network or for any other cellular network. The mobile phone 1 may also be a cordless phone, by way of example a DECT cordless phone. The mobile phone 1 comprises a printed wire board 3 on which various electric components and electrical connections are arranged. The mobile phone 1 further comprises a display 25. The display 25 may be a flat panel display.

Within the mobile phone 1, there is a cavity 5 in a region which the printed wire board 3 does not fill out. The cavity 5 provides a volume of space within the mobile phone 1. A first connector 11, a second connector 13 and a third connector 15 are facing the cavity 5 from the printed wire board 3. The first connector 11 is an antenna connector for the mobile phone 1. The mobile phone 1 is configured to use an antenna for its wireless or cordless communications. The first connector 11 is configured to electrically connect the circuitry on the printed wire board 3 to that antenna, which is thus external to the printed wire board 3. The first connector 11 is configured to carry the signals for the antenna from the printed wire board 3 and also carry the signals from the antenna to the printed wire board 3.

The second connector 13 and the third connector 15 are hands free loudspeaker connectors for the mobile phone 1. The second connector 13 and the third connector 15 are configured to electrically connect the circuitry on the printed wire board 3 to a hands free loudspeaker, which is thus also external to the printed wire board 3. The second connector 13 and the third connector 15 are configured to carry the signals for a hands free loudspeaker from the printed wire board 3.

The assembly 7 is fitted into the cavity 5 of the mobile phone 1 during assembly of the mobile phone 1 by separately fitting the hands free loudspeaker 23 and the antenna 9 into the cavity 5 of the mobile phone. It may be that the hands free loudspeaker 23 is fitted into the cavity 5 of the mobile phone in a first orientation or in a second orientation.

Alternatively, in the case that the assembly 7 is an integrated transducer unit comprising the hands free loudspeaker 23 and the antenna 9 or in the case that the assembly 7 is a rigidly connected assembly of the hands free loudspeaker 23 and the antenna 9, only a single orientation of the assembly 7 might ensure that the design of the antenna meets the desired requirements.

The antenna 9 is, by way of example, an antenna for a GSM cellular network. The antenna 9 may also be an antenna for a UMTS cellular network, for any other cellular network, or for any other wireless network, like for example a DECT network. The antenna 9 is used for transmission and reception of signals to and from the respective network. The antenna 9 is connected to electrical connection point 10.

The hands free loudspeaker 23 is a two-terminal device comprising a first electrical connection point 12 and a second electrical connection point 14 and converting the electrical signals received from the printed wire board 3 via the second connector 13 and the electrical connection point 12 as well as the third connector 15 and the electrical connection point 14 into acoustical signals. The hands free loudspeaker 23 further comprises a voice coil 19, a first decoupling coil 17, a second decoupling coil 21, a diaphragm 31, a permanent magnet 33 and a magnetic circuit element 29. The voice coil 19 is positioned in a magnet gap of the permanent magnet 33 formed by the magnetic circuit element 29. The voice coil 19 is further attached to the diaphragm 31 and causes a movement of the diaphragm 31 when an electrical signal is supplied to the voice coil 19. The first decoupling coil 17, the voice coil 19 and the second decoupling coil 21 are electrically connected in series. The first decoupling coil 17 and the second decoupling coil 21 are positioned immediately adjacent to the electrical connection point 12 and the electrical connection point 14, respectively.

Like any other similar structure with similar measurements, the voice coil 19 of the hands free loudspeaker 23 without decoupling coils is prone to act as a load on the antenna 9. It may also be that a metal chassis, a metal cover or metal terminals comprising a leaf or springs act as a load on the antenna 9. This effect is exacerbated by the close proximity of the hands free loudspeaker 23 to the antenna 9, especially because the hands free loudspeaker 23 and the antenna 9 are both comprised in the same assembly 7 within the cavity 5 of the mobile phone 1. In such a situation, the effectiveness of the antenna 9 for transmission of signals as well as for reception of signals may be compromised. This effect may be stronger when the hands free loudspeaker 23 is provided with a signal to create sound and the antenna 9 is used for transmission. The electrical characteristics of the antenna 9 as well as its operating parameters like frequency range, amplitude range and other parameters are also known based on the protocol for which it is configured. Further, because the geometrical arrangement as well as the other properties of the antenna 9 and the hands free loudspeaker 23 with the voice coil 19, the first decoupling coil 17, the second decoupling coil 21, the diaphragm 31, the permanent magnet 33 and the magnetic circuit element 29 are known, the way that the hands free loudspeaker 23 may potentially act as a load on the antenna 9 is also known.

What is also considered to be known is the impedance of the voice coil 19. The impedance of the first decoupling coil 17 and of the second decoupling coil 21 also contributes to the total impedance of the hands free loudspeaker 23.

In order to reduce the load of the hands free loudspeaker 23 on the antenna 9, the impedance of the first decoupling coil 17 and the second decoupling coil 21 may consequently be chosen to be high enough at frequencies above an operating frequency of the hands free loudspeaker 23 that the first decoupling coil 17 and the second decoupling coil 21 each acts as a decoupler at frequencies above an operating frequency of the hands free loudspeaker 23. An operating frequency of the hands free loudspeaker 23 may for example be any frequency which is in the audible range of acoustic frequencies. In particular, the first decoupling coil 17 and the second decoupling coil 21 may decouple the voice coil 19 from the second connector 13 and the third connector 15 within the frequency range in which the antenna 9 is operable.

The high impedance of the first decoupling coil 17 and the second decoupling coil 21 blocks the flow of current at frequencies beyond an operating frequency of the hands free loudspeaker 23 and thus prevents that energy transmitted by the antenna 9 at such a frequency is branched off toward the voice coil 19 by induced currents. Thus the load of the hands free loudspeaker 23 on the antenna 9 is reduced.

Based on the supposed knowledge of these factors and on the fact that the first decoupling coil 17 and the second decoupling coil 21 are arranged immediately adjacent to the second electrical connection point 12 and the third electrical connection point 14, respectively, with basically no signal line in between, the first decoupling coil 17 and the second decoupling coil 21 may be configured to each have an impedance which is simultaneously sufficiently high to electrically decouple the voice coil 19 from the electrical connection point 12 and thus from second connector 13 as well as from the electrical connection point 14 and thus from the third connector 15 at frequencies above an operating frequency of the voice coil 19, consequently reducing the load of the hands free loudspeaker 23 on the antenna 9, and sufficiently low so as not to compromise the power of the hands free loudspeaker 23. The impedance of the first decoupling coil 17 and the second decoupling coil 21 depends on the inductance of the first decoupling coil 17 and the inductance of the second decoupling coil 21, respectively. Thus a determination of an impedance of the first decoupling coil 17 and the second decoupling coil 21 which improves efficiency may be achieved. This has the effect of improving the effectiveness of the antenna 9 and curbing the added impedance of the hands free loudspeaker 23 at the operating frequencies of the electrical signals fed to the hands free loudspeaker 23. Thus there is better performance of the antenna 9 with less inductance. This also results in a lower loss for the hands free loudspeaker 23. The additional loss is negligible when the decoupling coils 17, 21 are integrated. The matching of the inductance of the first decoupling coil 17 and the second decoupling coil 21 on the antenna 9 is also in effect when the assembly 7 is used for a different kind of mobile device.

Further, because the decoupling coils 17, 21 are arranged close to the voice coil 19, the contribution of one or more signal line on the printed wire board 3 connected to the connectors 13, 15 to the load caused by the voice coil 19 on the antenna 9 is reduced or eliminated. Thus the decoupling coils 17, 21 can be dimensioned to take account of the load of the voice coil 19 on the antenna 9 and need not take into account effects of such signal lines as additional conduits relaying to the voice coil 19 energy received or transmitted by the antenna 9. Thus the assembly 7 may be used for different phones with different printed wire board configurations without needing to adjust the characteristics of the decoupling coils 17, 21. This enables greater simplification for design and sourcing.

The impedance of the first decoupling coil 17 and the impedance of the second decoupling coil 21 may be equal. The impedance of the first decoupling coil 17 may be unequal to the impedance of the second decoupling coil 21.

For the case that the assembly 7 is an integrated transducer unit, the total volume of the assembly 7 is less than the combined volume of a separate antenna, a hands free loudspeaker without decoupling coils and separate decoupling coils. An assembly 7 may be an integrated transducer unit according to an exemplary embodiment of the invention with a first decoupling coil 17 and a second decoupling coil 21. Also the result of the use of an assembly 7 which is an integrated transducer unit is a much simpler phone architecture. The mechanics become simpler by means of an assembly 7 which is an integrated transducer unit. The total number of components is reduced. Moreover, the omission of the external components makes the implementation of the routing strategy on the printed wire board 3 easier.

Figure 2:
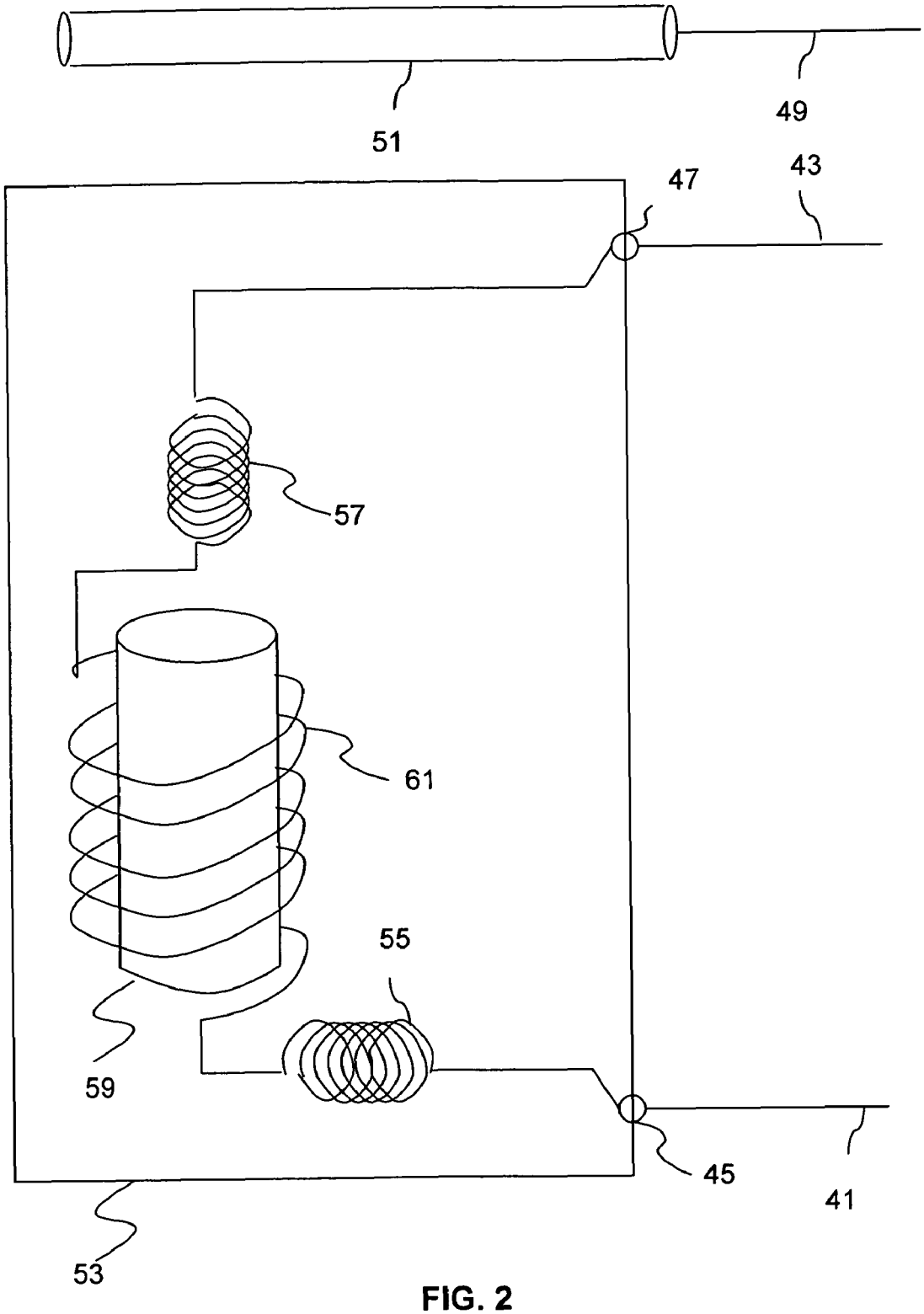
FIG. 2 is a schematic diagram illustrating a first or second apparatus according to a second exemplary embodiment of the invention.

FIG. 2 illustrates an antenna 51 and a first or second apparatus according to a second exemplary embodiment of the invention, which by way of example is an integrated hands free loudspeaker 53. The integrated hands free loudspeaker 53 comprises a first connection point 45 and a second connection point 47, each connection point being placed in a respective corner of the integrated hands free loudspeaker 53. The first connection point 45 and the second connection point 47 may alternatively also be placed in any other location of the integrated hands free loudspeaker 53.

The first connection point 45 is electrically connected to a first signal line 41 which is further electrically connected to a printed wire board of an electronic device, for example a mobile phone. The second connection point 47 is electrically connected to a second signal line 43 which is also further electrically connected to the printed wire board of the electronic device which is a mobile phone, by way of example. The first connection point 45 and the second connection point 47 are configured to make contact with connectors of the mobile phone configured to drive the integrated hands free loudspeaker 53.

The antenna 51 is an antenna of the mobile phone and is also electrically connected to the printed wire board of the mobile phone via an antenna signal line 49. The antenna 51 is used by the mobile phone for signal transmission and signal reception. The antenna 51 may be arranged in a cavity of the mobile phone in which also the integrated hands free loudspeaker 53 is fitted. The antenna 51 is arranged adjacent to the integrated hands free loudspeaker 53.

Alternatively, the integrated hands free loudspeaker 53 may be an earpiece 53 of a mobile phone which is a folded phone. In that case, the earpiece 53 and the antenna 51 may be adjacent and face-to-face when the mobile phone is in the folded state even though the earpiece 53 and the antenna 51 may not be arranged in the same cavity of the mobile phone.

In a further alternative, the integrated hands free loudspeaker 53 may also be an earpiece 53 of a mobile phone which is a monoblock phone. The monoblock phone may comprise the earpiece 53 at the top half of the monoblock phone as well as antenna 51 at the top half of the monoblock phone. In particular, the monoblock phone may comprise the earpiece 53 and the antenna 51 within the same cavity at the top half of the monoblock phone. Thus also an earpiece 53 of a monoblock phone at the top half of the monoblock phone may influence antenna 51 of the monoblock phone by acting as a load on antenna 51 of the monoblock phone.

The integrated hands free loudspeaker 53 further comprises a voice coil 59 and a magnet 61 for the loudspeaker functionality. The voice coil 59 and the diaphragm or cone of the integrated hands free loudspeaker 53 are configured to move within the magnet 61 depending on the electrical signal received by the voice coil 59, thus further resulting in the creation of sound waves. A first decoupling coil 55 is positioned geometrically adjacent to the voice coil 59 and electrically between the voice coil 59 and the first connection point 45. A second decoupling coil 57 is also positioned geometrically adjacent to the voice coil 59 and electrically between the voice coil 59 and the second connection point 47. Thus the first decoupling coil 55, the voice coil 59 and the second decoupling coil 47 are electrically connected in series. The decoupling coils 55, 57 decouple the voice coil 59 from the connection points 45, 47 and the signal lines 41, 43 at frequencies above an operating frequency of the voice coil 59. In particular, the decoupling coils 55, 57 decouple the voice coil 59 from the connection points 45, 47 and the signal lines 41, 43 in the frequency range in which the antenna 51 is operable. Because of the decoupling, the load of the voice coil 59 on the antenna 51 is reduced and the effectiveness of the antenna 51 improved.

Without the decoupling coils 55, 57 the load on the antenna 51 would depend on the one hand on the voice coil 59 and one the magnet 61. On the other hand, signal lines connected to the first connection point 45 and to the second connection point 47 on the printed wire board of the mobile phone could also contribute to the load on the antenna 51 by acting as a conduit for the energy transmitted or received by the antenna 51. The presence of the decoupling coils 55, 57 between the voice coil 59 and the connection points 45, 47 and thus also between the voice coil 59 and the signal lines on the printed wire board of the mobile phone reduces or eliminates the contribution of the signal lines on the load on the antenna 51. Thus the load on the antenna 51 essentially depends on the voice coil 59 and the magnet 61 and the decoupling coils 55, 57 may be designed accordingly regardless of the characteristics of signal lines external to the integrated hands free loudspeaker 53.

In addition, the close placement of the decoupling coils 55, 57 to the voice coil 59 dramatically reduces the load of the integrated hands free loudspeaker 53 on the antenna 51 independent of the actual orientation of the integrated hands free loudspeaker 53. It follows that also the distance and relative orientation to the antenna 51 decreases in importance in terms of the load of the integrated hands free loudspeaker 53 on the antenna 51. Thus already in the design phase of a device comprising the integrated hands free loudspeaker 53 the placement of the integrated hands free loudspeaker 53 may be more flexibly planned. Consequently, the design phase of such a device, for example a mobile phone, becomes easier.

Moreover, because the position and other mechanical characteristics as well as the electromagnetic characteristics of the antenna 51 are known and because the characteristics of the voice coil 59 and magnet 61 are known, the inductance of the decoupling coils 55, 57 can be matched to the performance characteristics of the antenna 51 such that the effectiveness of the antenna 51 is sufficiently improved. Thus no need arises for additional amplification stages for driving the integrated hands free loudspeaker 53. Also the efficiency of the antenna 51 is increased, which in turn may allow a reduction of the power needed to drive the antenna 51 and in the power of the driving amplifier for the antenna 51. The integration of the decoupling coils 55, 57 within the transducer 53 moreover permits the utilization of more space for the antenna 51, the transducer as whole, the printed wire board and other components. Consequently, the design options are enhanced and flexibility in planning and layout is increased.

Figure 3:
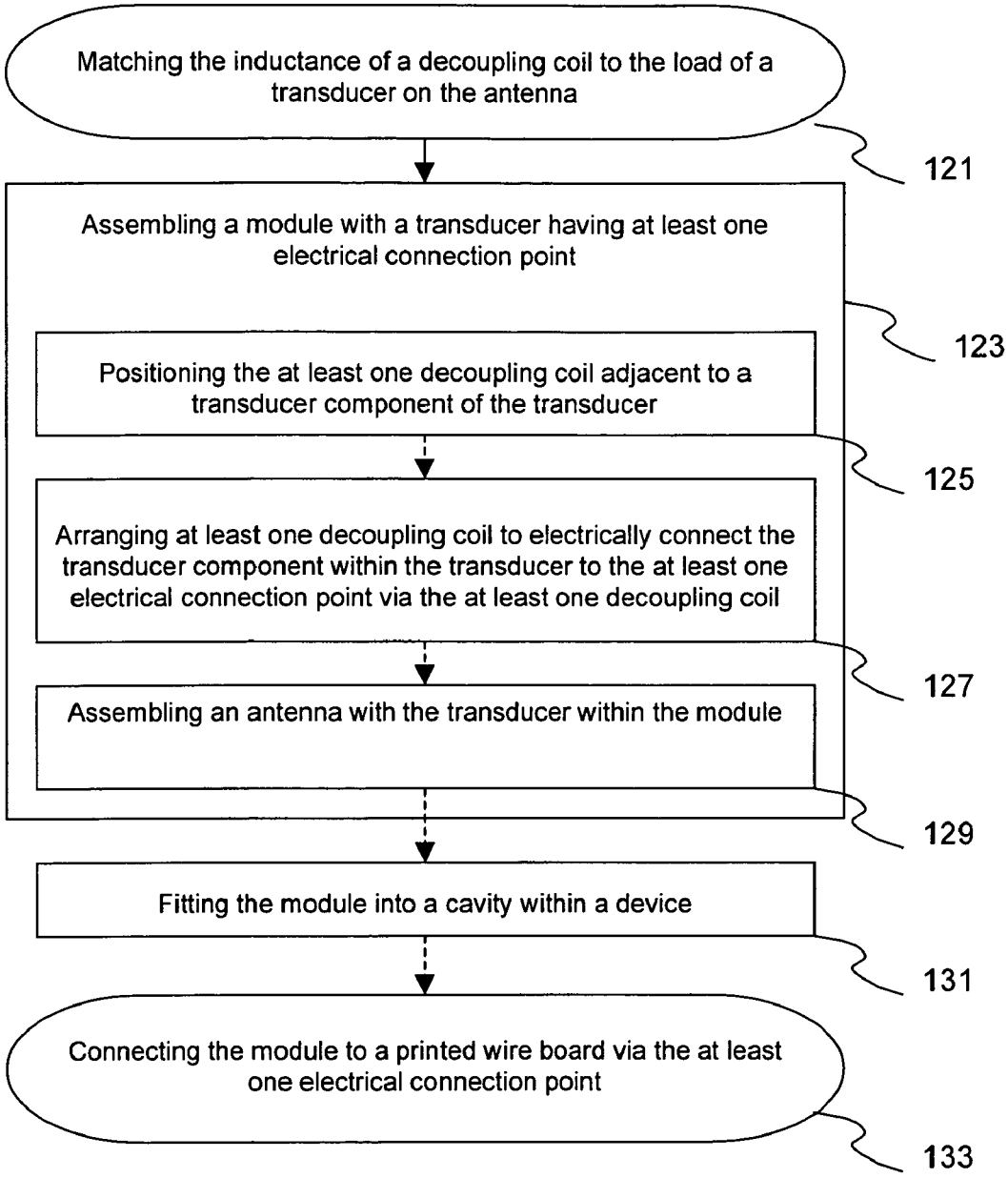
FIG. 3 is a flow chart illustrating a method according to an exemplary embodiment of the invention.

FIG. 3 is a flow chart illustrating an exemplary embodiment of a method for manufacturing a first or second apparatus comprising a transducer, which transducer comprises at least one electrical connection point. By way of example the apparatus is the assembly 7 of FIG. 1, which is a module. The individual actions 121, 123, 125, 127, 129, 131, and 133 illustrated in FIG. 3 may also be understood to describe functional blocks 121, 123, 125, 127, 129, 131, and 133 of a third apparatus for manufacturing a device comprising a transducer, which transducer comprises at least one electrical connection point. The functions illustrated by the functional block 123 can be viewed as means for assembling a transducer while the functions illustrated by the functional block 127 can be viewed as means for arranging at least one decoupling coil.

The inductance of a decoupling coil 17 is matched to the load of the hands free loudspeaker 23, which is a transducer, on the antenna 9 (action 121), in particular the load of the voice coil 19 of the hands free loudspeaker 23 on the antenna 9. Alternatively, a particular decoupling coil 17 with an inductance matched to the load of the hands free loudspeaker 23 on the antenna 9 is chosen from among a supply of decoupling coils with different inductances. The matching inductance of the decoupling coil 17 may be determined depending on the known characteristics of the antenna 9 and the operating boundary conditions of the hands free loudspeaker 23 and the antenna 9.

Next, the integrated transducer unit, which is a module with a transducer, namely the hands free loudspeaker 23, is assembled (action 123). The voice coil 19 is placed within the hands free loudspeaker 23, which is a transducer and which comprises at least one electrical connection point 10, 12. Further the permanent magnet 33, the magnetic circuit element 29 and the diaphragm 31, which are parts of the hands free loudspeaker 23, are also placed within the hands free loudspeaker 23 and arranged appropriately together with the voice coil 19 for the proper functioning of the hands free loudspeaker 23.

The assembly action 123 comprises a subaction 125, in which a first decoupling coil 17 is positioned immediately adjacent to a first connection point 12 and electrically connected to one end of the voice coil 19, which is a transducer component of the integrated hands free loudspeaker 23, i.e. of the transducer. Further, a second decoupling coil 21 is positioned also immediately adjacent to a second connection point 14 and electrically connected to the other end of the voice coil 19.

The assembly action 123 also comprises a subaction 127, in which the first decoupling coil 17 is arranged to electrically connect the voice coil 19, which is a transducer component within the integrated hands free loudspeaker 23, which is a transducer, to an electrical connection point 12. The first decoupling coil 17 has a matched inductance forming a high impedance configured to decouple the voice coil 19 from the electrical connection point 12 at frequencies above an operating frequency of the voice coil 19, e.g. at frequencies which are to be utilized by the antenna 9, which is to be used by the same mobile phone 1 via the electrical connection point 10. The mobile phone 1 is also configured to use the hands free loudspeaker 23. The voice coil 19 is analogously and electrically connected to an electrical connection point 14 by the second decoupling coil 21.

The assembly action 123 further comprises a subaction 129 comprising assembling the antenna 9 with the hands free loudspeaker 23, i.e. the transducer, within the assembly 7 which is a module. The antenna 9 is electrically connected to the electrical connection point 10.

The assembly 7 which is a module is then fitted into the cavity 5 of the mobile phone 1 (action 131).

Subsequently an electrical connection between electrical connection point 10 and connector 11, between electrical connection point 12 and connector 13 and between electrical connection point 14 and connector 15, and thus between the assembly 7, which is a module, and the printed wire board 3, is established (action 133).

The described actions need not be performed in this order. Any number of the described actions may be omitted. Moreover, they do not need to be performed at the same location or by the same entity.

The functions illustrated by the assembly 7 which is a module can be viewed as means for transducing while the at least one electrical connection point 13, 15 can be viewed as means for establishing at least one electrical connection and the at least one decoupling coil 17, 21 can be viewed as means for electrically decoupling.

Figure 4:
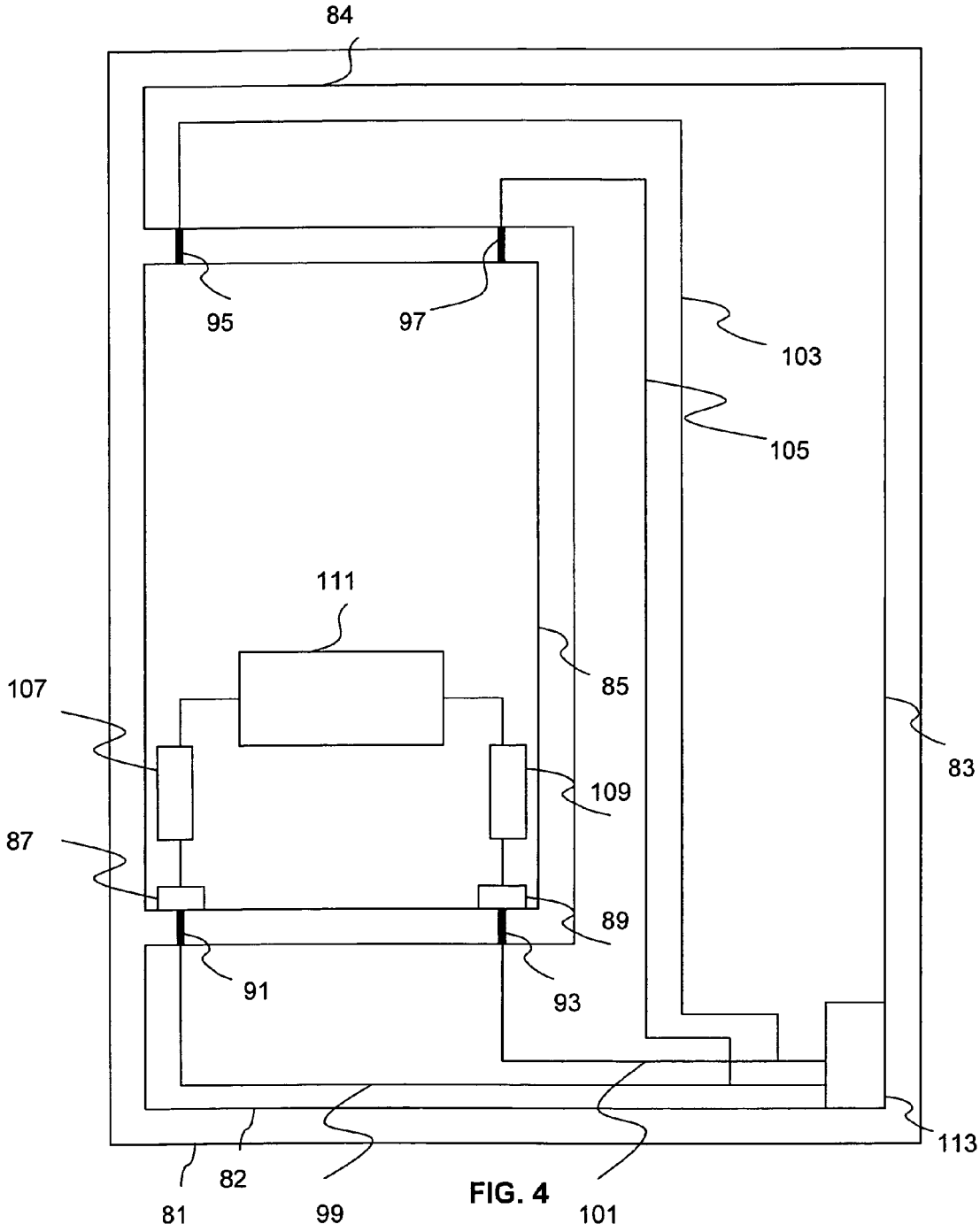
FIG. 4 is a schematic diagram illustrating a portable device comprising a first or second apparatus according to a third exemplary embodiment of the invention.

FIG. 4 illustrates that in a portable device in which a transducer may be connected in either one of two orientations an apparatus according to an exemplary embodiment of the invention reduces the load on the antenna. In FIG. 4, a portable device, in this case by way of example a personal digital assistant (PDA) 81, comprising a transducer 85 for integrated hands free loudspeaker functionality is illustrated. The portable device 81 or the transducer 85 can be seen as an exemplary embodiment of a first or second apparatus according to the invention. The PDA comprises a printed wire board 83 on which various electric components and electrical connections are arranged. The printed wire board has a lower edge 82 and an upper edge 84.

The transducer 85 is fitted into a cavity within the PDA 81 which is formed by a volume of space not used by the printed wire board 83. The transducer 85 is fitted into a cavity in a first orientation.

The printed wire board 83 comprises a first connector 91, a second connector 93, a third connector 95 and a fourth connector 97. The first connector 91, the second connector 93, the third connector 95 and the fourth connector 97 are connected to an audio amplifier 113 of the PDA 81 via a first signal line 99, a second signal line 101, a third signal line 103 and a fourth signal line 105, respectively. The first signal line 99 and the fourth signal line 105 are mutually connected. The second signal line 101 and the third signal line 103 are also mutually connected. The first signal line 99 and the second signal line 101 are each connected to a respective terminal of an audio amplifier 113 on the printed wire board 83.

The first signal line 99 and the fourth signal line 105 are connected to a first signal output terminal of the audio amplifier 113. The second signal line 101 and the third signal line 103 are connected to a second signal output terminal of the audio amplifier 113.

The first connector 91 and the second connector 93 are hands free loudspeaker connectors for the PDA 81. The first connector 91 and the second connector 93 are configured to connect the first signal line 99 and the second signal line 101, respectively, to a hands free loudspeaker, in this case the transducer 85.

The third connector 95 and the fourth connector 97 are also hands free loudspeaker connectors for the PDA 81. The third connector 95 and the fourth connector 97 are configured to connect the third signal line 103 and the fourth signal line 105, respectively, to a hands free loudspeaker, in this case also the transducer 85.

The transducer 85 comprises a first electrical connection point 87 and a second electrical connection point 89. The first electrical connection point 87 is connected to a voice coil 111 of the transducer 85 via a first decoupling coil 107. The second electrical connection point 89 is connected to the voice coil 111 of the transducer via a second decoupling coil 109.

When the transducer 85 is fitted into the cavity in a first orientation, in which orientation for example the first electrical connection point 87 and the second electrical connection point 89 are pointing toward the lower edge 82 of the printed wire board 83, the first electrical connection point 87 makes contact with the first connector 91 and the second electrical connection point 89 makes contact with the second connector 93. Thus the transducer 85 is electrically connected via the first signal line 99 and the second signal line 101 to the audio amplifier 113.

On the other hand, when the transducer 85 is fitted into the cavity in a second orientation, in which orientation by way of example the first electrical connection point 87 and the second electrical connection point 89 are pointing toward the upper edge 84 of the printed wire board 83, the first electrical connection point 87 makes contact with the fourth connector 97 and the second electrical connection point 89 makes contact with the third connector 95. Consequently the transducer 85 is electrically connected via the third signal line 103 and via fourth signal line 105 to the audio amplifier 113.

The dual routing consisting of the first signal line 99 and the second signal line 101 on the one hand and the third signal line 103 and the fourth signal line 105 on the other hand may be present because a designer may not be able to lock the transducer in only one orientation for assembly, i.e. in only the first orientation with the electrical connection points 87, 89 facing the lower edge 82 of the printed wire board 83 or in only the second orientation with the electrical connection points 87, 89 facing the upper edge 84 of the printed wire board 83.

If the transducer 85 did not comprise decoupling coils 107, 109, but instead a decoupling coil was arranged on the printed wire board 83 between the audio amplifier 113 and the connection of the first signal line 99 and the fourth signal line 105 and another decoupling coil was arranged on the printed wire board 83 between the audio amplifier 113 and the connection of the second signal line 101 and the third signal line 103, then, because of the different lengths of the signal lines 99, 101, 103, 105 on the printed wire board 83, the distance of these decoupling coils to the voice coil 111 as well as to the electrical connection points 87, 89 would be highly dependent on whether the electrical connection points 87, 89 are contacting the connectors 91, 93 or contacting the connectors 95, 97. That is the distance of these decoupling coils to the voice coil 111 would be dependent on an orientation of the transducer 85. The lengths of the signal lines 99, 101, 103 and 105 connected to the voice coil 111 would significantly affect the load on an antenna of the PDA 81 caused by the voice coil 111 by increasing the load of the voice coil 111 on an antenna of the PDA 81. Thus the acting load on an antenna of the PDA 81 as well as the effectiveness of the decoupling coils would be highly dependent on an orientation of the transducer 85.

However, because the decoupling coils 107, 109 are comprised in the transducer 85, a fitting of the transducer 85 into the cavity after a rotation of the transducer 85 from the first orientation to the second orientation does not change the distance of the decoupling coils 107, 109 to the voice coil 111 or the distance of the decoupling coils to the electrical connection points 87, 89. Thus the effectiveness of the decoupling coils 107, 109 is essentially independent of the orientation of the transducer 85, i.e. independent of whether the electrical connection points 87, 89 are facing up or are facing down.

Corresponding embodiments could comprise any other kind of transducer instead of the transducer 85 for integrated hands free loudspeaker functionality, for example a digital microphone. A digital microphone may comprise any number of pins, for example five pins. A digital microphone may comprise a first pin for a supply voltage for the microphone, a second pin for a ground voltage for the microphone, a third pin for a clock input to the microphone, a fourth pin for a pulse-density modulation (PDM) data output from the microphone and a fifth pin for a left/right channel selection of the microphone. The digital microphone may then comprise a decoupling coil for each one of the five pins.

The functions illustrated by the electrical connection points 12, 14, the connection points 45, 47 and the electrical connection points 87, 89 can be viewed as means for establishing at least one electrical connection while the decoupling coils 17, 21, 55, 57, 107, 109 can be viewed as means for electrically decoupling.

It is to be understood that any presented connection is to be understood in a way that the involved components are operationally coupled. Thus, the connections can be direct or indirect with any number or combination of intervening elements, and there may be merely a functional relationship between the components.

While there have been shown and described and pointed out fundamental novel features of the invention as applied to embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited functions and not only structural equivalents, but also equivalent structures.

What is claimed is:

1. An apparatus comprising a transducer, which transducer comprises at least one electrical connection point configured to enable an external electrical connection of the transducer; and at least one decoupling coil, wherein the at least one decoupling coil is positioned adjacent to at least one of the at least one electrical connection point of the transducer, which at least one decoupling coil is configured to electrically decouple the transducer from the at least one electrical connection point at a frequency above an operating frequency of the transducer.

2. The apparatus according to claim 1 comprising an antenna.

3. The apparatus according to claim 1, wherein the transducer is an electroacoustic transducer.

4. The apparatus according to claim 3, wherein the electroacoustic transducer comprises a voice coil and wherein the at least one decoupling coil is positioned adjacent to at least one of the at least one electrical connection point and the voice coil of the electroacoustic transducer.

5. The apparatus according to claim 2, wherein the inductance of the at least one decoupling coil is matched to the load of the transducer on the antenna.

6. The apparatus according to claim 1, wherein the at least one electrical connection point is configured to enable an external electrical connection of the transducer to a printed wire board external to the transducer.

7. The apparatus according to claim 6, wherein the at least one electrical connection point is positioned symmetrically on the apparatus and wherein the apparatus is electrically symmetric independent of the orientation of the apparatus.

8. The apparatus according to claim 1 comprising a display.

9. The apparatus according to claim 1, wherein the transducer is an integrated hands free speaker.

10. The apparatus according to claim 1, wherein the apparatus is a transducer.

11. The apparatus according to claim 1, wherein the apparatus is a mobile phone.

12. The apparatus according to claim 1, wherein the apparatus is a module for an electronic device.

13. A method comprising assembling an apparatus comprising a transducer, which transducer comprises at least one electrical connection point for enabling an external connection of the transducer; and arranging at least one decoupling coil within the transducer to electrically decouple the transducer from the at least one electrical connection point at a frequency above an operating frequency of the transducer.

14. The method according to claim 13, wherein the transducer is an electroacoustic transducer.

15. The method according to claim 14, comprising positioning the at least one decoupling coil adjacent to at least one of the at least one electrical connection point and a voice coil of the electroacoustic transducer.

16. The method according to claim 13, wherein assembling the apparatus comprises assembling an antenna within the apparatus.

17. The method according to claim 16 comprising matching the inductance of the at least one decoupling coil to the load of the transducer on the antenna.

18. The method according to claim 13 comprising fitting the apparatus into a cavity within a device.

19. An apparatus comprising a transducer comprising:

means for establishing at least one electrical connection enabling an external electrical connection of the transducer; and means for electrically decoupling the transducer from the at least one electrical connection point at a frequency above an operating frequency of the transducer.

20. An apparatus comprising:

means for assembling a transducer comprising at least one electrical connection point for enabling an external connection of the transducer; and means for arranging at least one decoupling coil to electrically decouple the transducer from the at least one electrical connection point at a frequency above an operating frequency of the transducer, wherein the at least one decoupling coil is positioned adjacent to at least one of the at least one electrical connection point of the transducer.

* * * * *